United States Patent [19]

Iwasa

[11] 3,998,634

[45] Dec. 21, 1976

[54] POWDER ELECTROPHOTOGRAPHIC METHOD

[75] Inventor: Masakazu Iwasa, Tokyo, Japan

[73] Assignee: Fuji Photo Film Co., Ltd., Minami-ashigra, Japan

[22] Filed: June 4, 1975

[21] Appl. No.: 583,657

Related U.S. Application Data

[63] Continuation-in-part of Ser. No. 463,806, April 24, 1974, abandoned.

[30] Foreign Application Priority Data

April 24, 1973 Japan .....46400/73

[52] U.S. Cl. ..... 96/1 R; 96/1 SD; 96/1.5; 96/1.8

[51] Int. Cl.[2] ..... G03G 13/22

[58] Field of Search ..... 96/1 R, 1 SD, 1.5, 1.8; 252/501

[56] References Cited

UNITED STATES PATENTS

| | | | |
|---|---|---|---|
| 2,758,939 | 8/1956 | Sugarman | 96/1.5 X |
| 2,885,556 | 5/1959 | Gundlach | 96/1 R X |
| 2,924,519 | 2/1960 | Bertelsen | 96/1 R |
| 2,940,847 | 6/1960 | Kaprelian | 96/1.8 X |
| 3,121,006 | 2/1964 | Middleton et al. | 96/1.5 |
| 3,607,363 | 9/1971 | Sadamatsu et al. | 96/1.8 X |
| 3,625,747 | 12/1971 | Kaneko et al. | 96/1.5 X |
| 3,775,103 | 11/1973 | Sadamatsu et al. | 96/1 R |
| 3,825,421 | 7/1974 | Tamai | 96/1 R |
| 3,833,365 | 9/1974 | Hiwano et al. | 96/1 SD |

*Primary Examiner*—Roland E. Martin, Jr.
*Attorney, Agent, or Firm*—Gerald J. Ferguson, Jr.; Joseph J. Baker

[57] ABSTRACT

An electrophotographic method comprising imagewise exposing the surface of a support having thereon (a) first photoconductive powders either positively or negatively electrically charged and (b) electroconductive powders having a surface resistivity of $10^{10}\Omega$sq or less or second photoconductive powders charged in a reverse polarity to that of the first photoconductive powders to form an electrostatic latent image, and then removing either the imagewise exposed or unexposed portion of the powders to form an image.

20 Claims, 5 Drawing Figures

FIG. 4
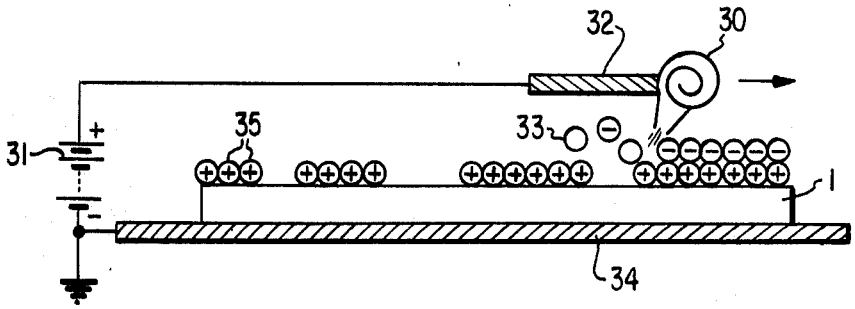
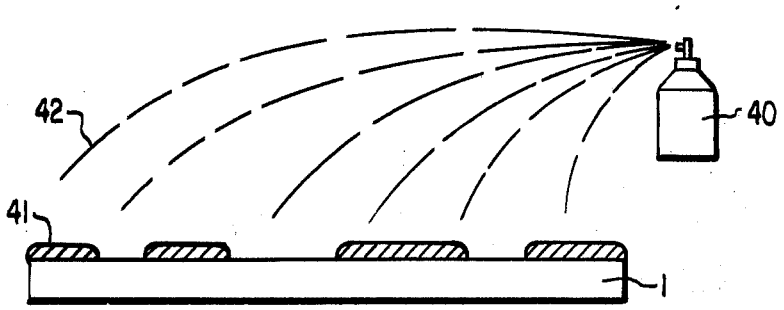
FIG. 5

POWDER ELECTROPHOTOGRAPHIC METHOD

CROSS REFERENCE TO RELATED APPLICATION

This application is a continuation-in-part of U.S. Pat. application Ser. No. 463,806 filed Apr. 24, 1974, now abandoned, and entitled "An Electrophotographic Method."

BACKGROUND OF THE INVENTION

1. Field of the Invention

The present invention relates to an electrophotographic method, and, more specifically, to an electrophotographic method in which an image consisting of powder is formed on an electrically insulating or electroconductive support.

2. Description of the Prior Art

Typical electrophotographic methods thus far developed, as is generally known, employ basically an photoconductive layer on an electro-conductive support. The photoconductive layer is charged in a uniform manner using a corona charger or the equivalent to a corona charger. As a result of the charging in a manner such as set forth above, the photoconductive layer is rendered appropriately photosensitive. Subsequently, image-wise exposure of the photoconductive layer is achieved using radiation of a spectral range which activates the photoconductive layer. Pairs of electrons and positive holes are generated in the areas of the photoconductive layer of an electrophotograph thus exposed to light, and these pairs of electrons and holes flow through the photoconductive layer, to thus dissipate the electrical charge present on the surface of the photoconductive layer.

In the manner as set forth above, an exposed area free from an electric charge, i.e., an area in such a state that a portion of an image is uncharged, in other words, an electrostatic latent image, is appropriately formed on the exposed section in such a manner as set forth above. This electrostatic latent image is converted into the final image using processes such as development, transfer, and fixation.

In this type of electrophotography, the electroconductive support in contact with the photoconductive layer plays a quite important role. To put it otherwise, the electroconductive support acts as either a grounding plate or the standard electrode at the time of corona charging. In addition, the electroconductive support functions as an electrode required at the time of dissipation of the electric charge of the exposed section. The latter function is especially important. When the photoconductive layer is subjected to corona charging or charging using some other means equivalent thereto, the electroconductive support has an electric charge of a reverse polarity to that induced on charging the photoconductive layer.

That is to say, an electric field is generated between the surface of the photoconductive layer and the electroconductive support due to the charging, and the photoconductive layer is thus rendered photoconductive. When the photoconductive layer in such a state is irradiated with light in the range of the spectrum which activates the photoconductive layer, pairs of electrons and positive holes are generated, and the electrical resistance of the photoconductive layer is reduced. As a result thereof, it is impossible for an electrical charge to be retained on the surface of the photoconductive layer, and the electric charge is dissipated.

To effect this dissipation of the electric charge, it is necessary for and electric current to flow through the photoconductive layer. To cause an electric current to flow through the photoconductive layer, an electric field is required, and for this purpose, an electroconductive support is required. The electroconductive support thus acts as an electrode.

As used herein, the term electroconductive support means a support such as a metal plate, a paper or another insulating support coated with a thin metal film or another electroconductive substance, a paper or another electroconductive substance under an appropriate relative humidity, which has a surface resistance of approximately $10^{10}\Omega$sq.

As described above, this electroconductive support is both important and indispensable for these prior electrophotographic methods. Therefore, it is quite difficult, generally, to form an image in an electrophotographic manner without an electroconductive support.

Furthermore, some methods analogous to the present invention have been described in British Pat. Nos. 990,438, and 1,198,497, and so forth. Each and every one of these methods involve a method of forming a powder image of on a support, especially on a material to be processed, by the employment of a photoconductive powder. The method disclosed in the specification of British Pat. No. 990,538 is a method of forming an image of a photoconductive powder on the surface of a processed material having the property of being more or less electroconductive. In addition, the method described in the specification of British Pat. No. 1,198,497 is a method having features in which a processed material whose surface is electrically insulating is appropriately surface treated, to thus render the surface (more or less) electroconductive.

As exemplified above, each and all of these methods merely proves to be effective only where the surface of a processed material is electroconductive. However, in the method of the present invention, a photoconductive powder image can be formed, in an appropriate and advantageous manner, even on the surface of a support which is either electrically insulating or electroconductive. In this respect, the method of the present invention is entirely different from any of the conventional methods, and is believed to be quite an important advance in the art.

SUMMARY OF THE INVENTION

The object of this invention is to provide an electrophotographic method in which either an electrically insulating or an electroconductive surface of a support can be used.

This invention provides an electrophotographic method comprising image-wise exposing the surface of a support having thereon photoconductive powders either positively or negatively electrically charged and electric conductive powders charged in a reverse polarity to that of the photoconductive powders to form an electrostatic latent image and then removing the image-wise exposed portion of the powders to form an image.

BRIEF DESCRIPTION OF THE ACCOMPANYING DRAWINGS

FIG. 1 through FIG. 5 show an embodiment of the method of the present invention.

FIG. 1 shows a state in which the photoconductive powder is charged positively and spread on the surface of a support.

FIG. 2 shows a state in which powder charged negatively is spread over the surface of the spread powder charged positively.

FIG. 3 shows a state in which image exposure is conducted by radiation, to form an electrostatic latent image.

FIG. 4 shows the use of an air stream under the conditions in which a bias voltage is applied, to remove gradually the negatively charged powder in the exposed areas.

FIG. 5 shows the fixing of the unexposed areas (remaining areas).

DETAILED DESCRIPTION OF THE INVENTION

1. In step one, a charged photoconductive powder is scattered uniformly over the surface of a support, e.g., a processed material (the electroconductivity of whose surface may well be ignored).

At this time, it is preferred that the scattering of the charged powder and charging thereof are conducted in such a manner that the surface of the support is kept free from being charged. Where the surface of the support is electroconductive, this constitutes no problem; however, where the surface of the support is electrically insulating, usually special precautions are taken to prevent from fogging. The charged powder and the surface of the support are in point-contact; therefore, some portions of the surface of the support remain charged even after exposure. The remaining charged area has an electrical attraction and thus it causes fog. Thus, it should be understood that the support is preferably not charged, but it may be charged as far as the fogging caused by the charge can be ignored or tolerated. Normally, it is preferred that the support is not charged in an amount more than about one-fifth of the charge of the positive or negative powders.

Figure 1:
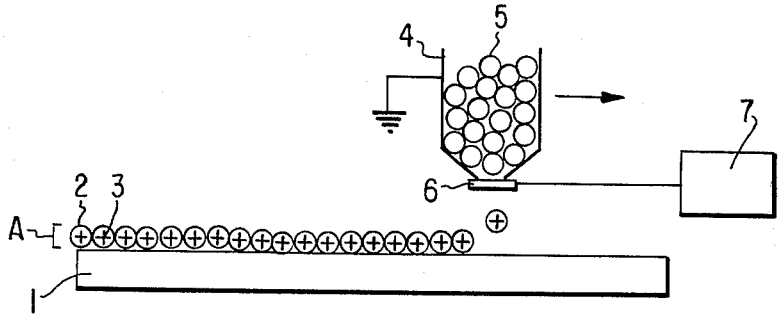

Such a state is shown in FIG. 1 in which a photoconductive powder is charged and the powder spread over the surface of the support.

In FIG. 1, 1 is a support. A photoconductive powder is charged and scattered over the support 1 by the employment of a powder feeder, sprinkler or duster 4 (hereinafter, simply feeder). 2 is a photoconductive powder thus scattered, and 3 is the polarity of the electric charge thereof. The polarity of the electric charge may well be either positive or negative, and in this case the polarity is shown to be positive as an example. 5 is the photoconductive powder still remaining in the powder feeder yet to be fed, and the powder is given an appropriate electric charge by passing through an charging section 6. The charging section 6 is connected with a high-voltage electric powder supply 7.

This charging section 6 is of such a design that it is quite capable of electrically charging only the photoconductive powder, without charging the surface of the support. The layer of such a charged photoconductive powder thus scattered at this initial stage (1) is designated layer A.

Figure 2:
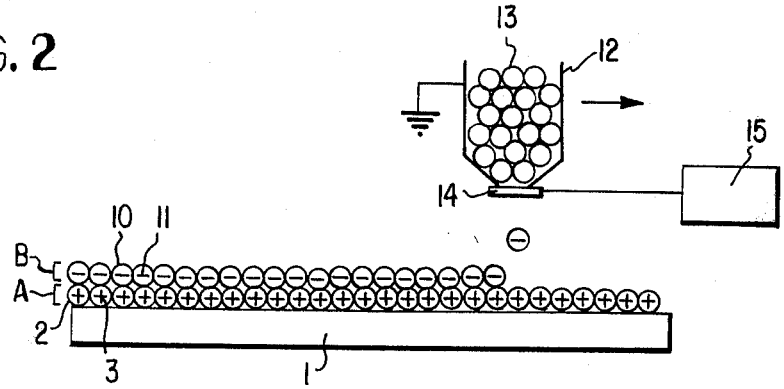

2. Next, an electroconductive powder charged a reverse polarity to that of (1) above is scattered over the charged photoconductive powder and is scattered in a manner as set forth in (1) above. Such a state as this is shown in FIG. 2. In FIG. 2, 12 is a powder feeder, sprinkler, or duster, and 13 is the electroconductive powder still remaining in the powder feeder yet to be scattered. 14 is charging section, which charges the electroconductive powder in a reversed polarity to that in the case of (1) above. In this example, the photoconductive powders are charged here in a negative polarity. Furthermore, 14 may well be of such a design and construction that only the scattered powder is charged, in the same manner as in the case of (1) above. In addition thereto, 14 is connected with a high-voltage electric powder supply 15. 10 shows the electroconductive powder scattered in a similar manner, and 11 shows the polarity of the electric charge thereof.

The layer of such a charged and scattered powder at this stage of (2) is designated layer B.

The layer of the powder scattered at this stage forms a electric double layer between layer A and layer B, to thus form such an electric field and such a charge as are required to have the electric charge of the layer of the photoconductive powder appropriate for neutralization upon irradiation with light.

3. Then, image exposure is conducted by the employment of light and/or radiation including therein the range of the spectrum which activates the photoconductive powder.

Figure 3:
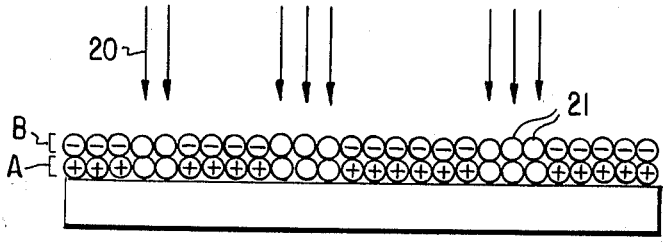

The state hereof is shown in FIG. 3. 20 shows the incident light at the time of image exposure. The photoconductive powder in those areas irradiated with this light become electroconductive, and neutralization of the electric charge takes place between the electric double layers. 21 is such a photoconductive powder whose electric charge is neutralized upon irradiation with light. At this stage an electrostatic latent image is formed.

4. The electrostatic latent image is then developed. In the method of the present invention, this development is usually conducted by removing the layer of the powder whose electric charge is neutralized. Suitable removal techniques for development can be using vibration or an air stream or a combination thereof.

The development can also be conducted by removing the layer of the powder whose electric charge is not neutralized. The development is carried out, for example, by applying a bias voltage opposite in polarity to that of the unneutralized charge of the upper layer followed by the application of a bias voltage opposite in polarity to that of the unneutralized charge of the lower layer. Reference should be made to Example 20 for a detailed description of a typical embodiment where non-exposed powders are removed.

In FIG. 4, 34 is an electroconductive support, wherein a process material 1 is placed adjacent this electroconductive 34. A plate 32 is disposed on the photoconductive powder layer side, and a bias voltage is applied between the plate 32 and the electroconductive base 34. The polarity of this bias voltage is so selected that the plane 32 has the same polarity as that of the layer A. In this embodiment, the plate 32 is positive (+). When the bias voltage is applied in such a manner as set forth above, only that photoconductive powder which has the electric charge of layer A adheres to the surface of the support. 31 is an electric powder source for the application of a bias voltage.

In such a state as this, air is blown by a blower 30. By virtue of this air stream, the electroconductive powder charged in layer B having no force adhering it to the surface of the support, and the powder in such a portion of layer A and layer B which has been exposed to an image, thus having the electrical charge appropriately dissipated, are all blown off. 33 is powder thus blown off, and 35 is the photoconductive powder which remains intact on the surface of the support, without being blown off. A photoconductive powder conforming to the pattern of the unexposed portion is formed in such a manner as set forth above.

The method shown in FIG. 4 represents an embodiment of the developing process, and it goes without saying that any other appropriate techniques may be applied as well for the purpose of effecting the development. Where a photoconductive powder of such a design in which an insulating film (e.g., a coated film) is formed on the surface of an electroconductive substance like a metallic material or the like, it is evident that development can be conducted simply using, e.g., an air stream alone, without employing an electrode for a bias voltage.

5. An image formed of such a powder in such a manner as set forth above is fixed either as it is or after transfer onto another support, to be thus formed into the final image. With regard to the method of fixation, methods employing heat, a solvent, or another appropriate method can be employed.

FIG. 5 shows a fixing using a solvent. In this case, a solvent 42 is sprayed using a solvent spray gun 40. 41 is an image (formed of a powder) thus subjected to fixation. The principle of the method introduced in the present invention is as set forth above.

As described above, the formation of an electric double layer using a photoconductive powder either charged positively or negatively and another powder charged in the reverse polarity to that of the photoconductive powder is an essential point of the method of the present invention. Furthermore, now that dissipation of the electric charge using irradiation of rays or radiation is effected at a position in contact between the powders, any type of powder, as a rule, can be suitably employed for this purpose, so long is an electroconductive powder (e.g., having a surface resistivity of less than $10^{10}\Omega$sq.) which can be charged in a reverse polarity to the photoconductive powder. However, employment of a photoconductive powder rather than an electroconductive powder better serves to improve the prospective effects of irradiation, and hence is more advantageous.

In summary, employment of powders which are a phototransparent at least part of the range of wavelength to which the photoconductive powder is responsive well proves to be more effective.

In the method of the present invention, a photoconductive powder which is usually employed in conventional electrophotography advantageously can be selected for this purpose. To put it otherwise, the powder desirably contains a photoconductive substance as a part of the composition thereof.

The particle size of the photoconductive and electroconductive powders used in the present invention can be optionally selected. The size of these powders is preferably selected from a range of 1 – 200 microns. It is difficult to manufacture a powder having a size less than 1 micron, and some difficulties may occur in the image producing process when a power having a size more than 200 microns is used. To obtain excellent quality in resolution and clearness it is preferable to use a powder which has a size less than 150 microns. From the point of view of (a) manufacturing the powder, (b) the control (handling) of the powder in the process of the present invention and (c) the resolution of the image, it is proper to use a powder having a size of 20 – 100 microns, and the most preferred size is 40 – 50 microns. It is very easy to handle powder having a size of 40 – 50 microns, and excellent images can be obtained using such a powder.

The size described above is an average of the particle diameter and corresponds to the peak value of a distribution curve of the particle size. When the distribution of the particle size is approximated by the normal distribution, it is preferred that there is the following relationship between $\sigma$ and $\mu$.

$$2\sigma \leqslant \mu$$

where $\sigma$ represents the standard deviation and $\mu$ represents the average value of the particular diameter. In this case 95% of powder exist in $0 - 2\mu$.

In the dark, it is desirable that the photoelectric insulating powder has a period of one minute or longer, with either a positive or a negative electrostatic charge of approximately several hundred volts properly given, and generally, it is desirable that the electrostatic charge can be maintained at least for the period corresponding to the cycling time of electrophotography, or a period of 10 minutes or over. In the dark, the powder is characterized by the retention of high electric charge; however, the powder must form a layer which discharges the electric charge in response to irradiation with active illumination and retains only a negligible residual electric charge to such radiation. For commercial purposes, it is preferable that the photosensitive powder can be responsive to rays in a quantity of light of less than 1500 lux. sec, and, generally, the photosensitivity must be of such that the electric charge is extinguished virtually completely within an exposure time of approximately 0.001 to 10 seconds. In addition, it is preferable that the photoelectric insulating powder be quite capable of coping with high-speed operation for commercial purposes upon exposure to a stroboscopic flash.

Furthermore, since the powder constitutes the material for the final image, it is desirable that the powder be visible on an appropriate print support surface, and that the powder be quite capable of forming an image which is useful and be capable of detecting any fluctuation in at least the absorptive reflection of rays, the diffusion of rays, or other detectable electric and/or mechanical characteristics.

In addition thereto, in employing the photoconductive powder as a powder for positive charging, or as a powder for negative charging, either a powder of the same type or a powder of a different type, may well be selected for the purpose. However, of course, it goes without saying that it is more favorable to employ powders of the same type, in view of effective operation.

A number of different kinds of photoconductive powder; for instance, a photoconductive material which contains a sulfide or an oxide of zinc, cadmium or the like, or a selenide can be selected for this purpose. Specific examples of such are zinc oxide, mercury sulfide, lead sulfide, tellurium compounds, titanium white, compounds of cadmium sulfide and cadmium carbonate, or other compounds. In addition, an organic photoconductor, especially, metal-free phthalocyanine, polyvinylcarbazole, or the like, can be selected for use in the method of the present invention. Such a photoconductive material can be dispersed into an appropriate resin as a binder, and then given an appropriate treatment for enabling both positive and negative charging.

With regard to the resin thus selected as the binder, virtually any kind of resin can well be selected for this purpose, so long as it can be used for an electrophotographic photosensitive layer of the binder type as generally used for Electrofax, (trade name, produced by RCA). For instance, alkyd resins, styrene or acryl ester denatured alkyd resins, epoxy-ester resins, rosin and/or phenol resins, denatured alkyd resins, terpene resins, butylated melamine resins, styrene copolymers (for example, copolymerized with monomers such as butadiene, acrylonitrile, acrylic acid esters methacrylic acid esters, or the like), vinyl chloride - vinyl acetate copolymers, partially saponified copolymers of vinyl chloride - vinyl acetate, polyvinyl acetate, vinyl acetate copolymers (for example, copolymerized with monomers such as crotonic acid, acrylic acid, methacrylic acid, acrylic acid esters, methacrylic acid esters, or the like), polyalkylmethacrylates, polyalkylacrylates, or copolyers composed mainly of alkyl acrylates or alkyl methacrylates can be selected for this purpose.

One method which enables charging in both the positive and negative polarities is to employ a powder which has a photoconductive layer around a highly insulating core material. In this case, the photosensitivity tends to decrease during charging either positively or negatively. Another method presently available employs a P type photoconductor and a N type photoconductor jointly and concurrently. These photoconductors may well be either coated on a highly insulating core material or the photoconductors themselves may well be powdered. These processes may well be combined with the procedures described in Japanese Pat. Application (OPI) No. 99034/1974 or in Japanese Pat. Application (OPI) No. 107246/1974.

The total amount of positive and negative charges on the powders on the support should be approximately or exactly zero. It is difficult to make the total amount of charges exactly zero, and when it is not exactly zero, a fog tends to occur. But this fog can be lessened to certain extent during development; therefore, the total amount of charges need not be exactly zero. When development is carried out by blowing air, the amounts of positive and negative charges may be different from each other within 15% based on the amount of charge. Furthermore, in the method of the present invention, no limit is imposed at all, with regard to the support.

A feature of the present invention lies in that the image formed of the powder can be obtained electrophotographically on a insulating support As was set forth above, it is generally impractical in any conventional electrophotographic process to form an image on an insulating support. A detailed description will be given below, employing a photoconductive powder.

In the method of the present invention, electric double layers of photoconductive powders are formed on a support, and the electric charge in the exposed image areas of the photoconductive layer of the powder is dissipated between the electric double layers, whereby an electrostatic latent image is formed, and the support matter is not required to be electroconductive.

The fact that an image can be formed electrophotographically, even on an insulating support, in such a manner as set forth above, is a most important feature of the method of the present invention, and such has not been previously known. Furthermore, another feature of the method of the present invention is that an image can be formed electrophotographically not only on an insulating support (e.g., a support having a resistance of $\geq$ about $10^{13}\Omega$sq.) but also on an electroconductive support (e.g., a support having a resistance of $\leq$ about $10^{10}\Omega$aq.), and even on a support having an intermediate resistivity (e.g., a support having a resistance of about $10^{10}$ to $10^{13}\Omega$sq.). Materials to be used for the support in the present invention are metals, plastics, rubbers, papers, woods, concrete cloth, and the like. The above description clearly sets this forth. It is also clear that an image can be formed as well even on a support which has electroconductive areas and insulating areas present the same support. To put it otherwise, the method of the present invention is completely free from any limitation whatsoever with regard to the resistivity of the surface of the support. The method of the present invention can be appropriately applied to any general copier of the dry type in the same manner as in the case of xerography. Further, the shape of the support may be selected optionally in the present invention.

In addition, the method of this invention is applicable to many other uses by employing a feature of the present invention in which a powder image can be formed on an insulating support. For one thing, this method can be employed for marking-off section lines, weld lines or the like appropriately displayed on a steel plate coated with a paint. A system similar to the present invention is commercially marketed by Fuji Photo Film Co., Ltd., under the trade name of the EMP system, wherein an electroconductive paint is selected for use as a coating material. However, the method of the present invention makes it practical to conduct marking-off on general painted steel plates as well, without coating the plates with the special coating material employed in this commercial system.

As far as the description of the method of the present invention is concerned, photoconductive powders charged positively and negatively, respectively, can be scattered concurrently, in lieu of the separate processing steps of scattering of a powder charged in positive and negative reverse polarities, to thus form an electric double layer. In the former case, an electric double layer is not formed: however, the layer of the powdered matter still possesses an electric field, as well as positive and negative electric charges, locally, thus resulting in neutralization of the electric charges effected by irradiation of rays.

In the present invention a charged electroconductive powder may be scattered over an electroconductive support. In this case, a charged photoconductive powder is scattered over the layer of electroconductive powder. The charged electroconductive powder may lose charge to ground through the conductive support. The exposure and the development can be carried out as described hereinbefore. The phenomenon involved in producing an image by this method is very similar to that of the known method in which an electroconductive support and only photoconductive powder are used. But in the method described above there are advantages which can not be obtained by the known method. For example, in the method described above the image can be produced only from the electroconductive powder as illustrated in Example 19 and the photoconductive powder can be collected and reused. Usually, the photoconductive powder is more expensive than the electroconductive powder, Therefore, an image can be produced at a moderate price by using the method of the present invention. The composition of the photoconductive powder is restricted, but the composition of the electroconductive powder may be optionally determined - that is, dyes, pigments or certain chemicals can be very freely added to the composition of the powder. If a metal powder is used as the electroconductive powder, a metal image can be obtained. The metal image may be fixed, for example, by spraying a lacquer over the metal image.

In the method of the present invention, it is practical as well to employ two or more kinds of photoconductive powders of different compositions, including photoconductor, binder resin, colorant, sensitizer, particle size, specific gravity, and so forth. Especially, under certain conditions, it is advantageous that two or more kinds of different powers be employed concurrently. These powders can be applied successively on the powder receiving surface to form a pattern of intersperced lines, dots or the like; and more generally speaking, either these materials are simply mixed together, for scattering concurrently using a scattering apparatus, or different types of photoconductive powders can be employed for layer A and layer B, respectively. The differnt types of photoconductive powders are generally different from each other in spectral response to active radiation, or in another detectable visible appearance, or in other physical properties. It is known that different photoconductors have different sensitivities, i.e., different kinds of chromatic sensitivities. These differences can be further modified either by the employment of such an active impurity or photosensitive dyes as is known, or by dyeing the powders to broaden the spectral sensitive region by sensitization or the like. By the application of such a process as is set forth above, the difference in exposure between layer A and layer B can be supplemented practically, by the employment of a photoconductive powder having a high sensitivity for tye layer A (e.g., an ASA of about 0.1 to 0.5), while a photoconductive powder having a low sensitivity is used for layer B (e.g., an ASA of about 0.01 to 0.1), where layer A is exposed less than layer B. It is also practical to supplement the difference in exposure by the employment of photoconductive powders of different levels of spectral-sensitivity for layer A and layer B, respectively. Furthermore, it is practical as well to form a colored image of a powder by the employment of three or more types of photoconductive powders of different levels of photosensitivity. The present invention as had been described above in detail from a technical standpoint; however, it still goes without saying that one skilled in the art can easily conceive of various modifications and uses thereof, and it goes without saying as well that all such modifications are duly included in the scope of the present invention.

The method of the present invention will be illustrated in greater detail below by reference to the following Examples.

EXAMPLE 1

An EPM phototoner manufactured by Fuji Photo Film Co., Ltd. was specifically selected for use as a photoconductive powder. The EPM phototoner is a powder having high phototransparency, containing zinc oxide spectrally sensitized up to the range of visible rays, and having an average particle diameter of approximately 50$\mu$.

A metal plate coated with a paint was employed as a support. The surface resistance of the paint coated surface was $10^{14}\Omega$sq. or higher.

Since the EPM phototoner has better sensitivity for negative charging than for positive charging, negative charging was conducted at the time of the scattering of the photoconductive powder for layer A, i.e., the first time, and positive charging was conducted at the time of the scattering of the photoconductive powder for layer B, i.e., the second time. Because the photoconductive powder absorbs rays at exposure; therefore, the exposure of the lower layer (layer A) of the photoconductive powder was less than that of the upper layer (Layer B) of the photoconductive powder; however, the difference in the exposure can be offset by providing the lower layer with a higher sensitivity.

The scattering of the photoconductive powder the first time and that of the second time were both conducted at the rate of 50 g/m$^2$ to 150 g/m$^2$. (The true specific gravity of the EPM phototoner is approximately 1.53.)

The charging was conducted by exposing the powder in a corona ion flow, using a corona charger. Furthermore, in conducting the scattering of the photoconductive powder of the first time and that of the second time, the absolute value of the charging of the latter was so controlled that it was equivalent to that of the former, i.e., equal in value but opposite polarity.

In this charging and scattering of the photoconductive powder, the surface potential at the time of conducting the scatter of the photoconductive powder of the first time and that of the second time in an independent manner, respectively, was in the range of 100 to 400 volts, resulting in a surface potential of about $10^{-5}$ coulomb/cm$^2$.

After the charging and the scattering of the photoconductive powder in such a manner as set forth above, exposure to an image (100 – 1,000 lux. sec) was conducted.

Thereafter, the layers of photoconductive powders were exposed to an air jet to simultaneously remove both the exposed powders that were positively charged and those that were negatively charged, whereby development thereof was conducted. The air velocity at this time was 15 – 25 m/sec on the surface of the material. No bias voltage was applied.

As a result whereof, a superb photoconductive powder image could be obtained.

EXAMPLE 2

With regard to the materials to be processed, polyethylene therephthalate in the form of a film of thickness of 125$\mu$) was selected for use as a highly polymerized insulating material, and the EPM phototoner was employed as a photoconductive powder in the same manner as in the case of Example 1. The scattering of the photoconductive powder, charging, exposure, and development conditions were the same as in the case of Example 1. However, a bias voltage was applied in the case of development.

The bias voltage was in the range of 10V/cm – 500 V/cm.

As a result, a distinct image could be obtained in the same manner as in the case of Example 1. Also in the case of conducting the same operation, with the materials to be processed appropriately replaced with a vinyl chloride plate and an acrylic resin plate, desirable results could be obtained.

EXAMPLE 3

The same operation was conducted in a similar manner to that set forth above using a metal plate, paper, and other electroconductive materials as the support. These materials all had a surface resistivity of $10^{9}\Omega$sq.

or less. In this case, the EDM phototoner was selected as a photoconductive powder, and the conditions, including the scattering of the photoconductive powder, charging, exposure, and development, were the same as in the case of Example 1.

When tests were conducted under these conditions, desirable results were be obtained.

EXAMPLE 4

Metallic materials (i.e., iron or aluminum plates of a thickness of 2 mm), were employed as the materials to be processed having a coat of paint on the surface thereof into an image pattern, and with a highly polymerized insulating film to coat the image pattern. The surface resistivity of the insulating section was $10^{12}\Omega$sq. or higher, and the surface resistivity of the electroconductive section was $10^{3}\Omega$sq. or lower.

The EPM phototoner was selected as a photoconductive powdered matter, and when tests were conducted under the same conditions as in the case of Example 1, desirable results were obtained.

Even when an electroconductive section and an insulating section are present on the surface of the same material to be processed, as set forth above, desirable results were obtained.

EXAMPLE 5

In the case of the Examples 1, 3 and 4 above, when tests were conducted by applying a bias voltage of 10 – 200 V/cm, much better results than in the case of Examples 1, 3 and 4 were obtained.

EXAMPLE 6

When tests were conducted by the employment of paper having a surface resisitivity of $10^{7}\Omega$sq – $10^{10}\Omega$sq, and by the application of the same processes as in the case of Example 2 above, desirable results were obtained.

EXAMPLE 7

An example of employing metal-free phthalocyanine as a P-type photoconductor and ZnO as an N-type photoconductor are shown in this Example.

In this case, 50 parts of photoconductive ZnO and 30 parts of X-form metal-free phthalocyanine were dispersed into 30 parts of a copolymer of vinyl chloride and vinyl acetate by selecting a mixture of methyl ethyl ketone - butyl acetate as a solvent. The solution was coated on glass spheres (having an average particle diameter of about $30\mu$) and subjected to drying. The thickness of the coated layer was approximately $3\mu$. The photoconductive powder thus obtained could be charged both positively and negatively, and had a good light decay rate in either case.

When the same operation as in the case of Example 1 was conducted by the employment of this solution, a desirable result was obtained.

EXAMPLE 8

The use of two kinds of photoconductive powders, i.e., the EPM phototoners (including ZnO which is an N-type semiconductor) manufactured by Fuji Photo Film Co., Ltd. and commercially available is shown in this Example. This is charged negatively, and quick in attentuation of rays. The particle diameter of the photoconductive powder was approximately $50\mu$.

The other photoconductive powder employed comprised 20 parts of X-form metal-free phthalocyanine and 100 parts of a solvent-soluble polyester resin, thoroughly mixed with a mixed solvent of methyl ethyl ketone - toluene, and spray dried. The diameter of the particles of the photoconductive powder was $15\mu$.

The phthalocyanine photoconductive powder was first charged positively and then scattered over a highly insulating film. Subsequently, the EPM phototoner was scattered, while being charged negatively, then exposed to an image. When the highly insulating film was developed using an air stream, a superb image was obtained.

The two kinds of photoconductive powders were recovered and appropriately sieved for reuse.

A method similar to the one that employs a combination of an electroconductive powder and a photoconductive powder charged in the reverse polarity to each other is disclosed in German OLS No. 2,154,146 (corresponding to U.S. Pat. No. 3,825,421). However, the method of the present invention is entirely different from the method of German OLS No. 2,154,146 in those point set forth below.

In detail, the method disclosed in German OLS 2,154,146 is a method in which the surface of an insulating support is charged, an electroconductive powder is adhered to the surface by the application of electrostatic attractive force, and then a charged photoconductive powder is scattered over the surface, whereby the charged photoconductive powder is electrostatically adhered to the layer of the electroconductive powder thus formed initially. After, image exposure, the photoconductive powder whose electric charge is reduced is removed, and the photoconductive powder (corresponding the original image pattern) remaining thereon is fixed. In this case, the electroconductive powder remaining on the surface of the support is not removed in the developing process. (The electroconductive powder on the background is removed after fixation of the photoconductive powder.) Therefore, the fixing process applied to the photoconductive powder must be one which is not capable of fixing the electroconductive powder. For this reason, the electroconductive powder in the lower layer of the image pattern area (i.e., on the surface of the support) remains intact in the form of a powder, without being properly fixed. That is, the electroconductive powder is not properly fixed on the surface of the support (thus giving rise to an unnecessary intermediate layer). Therefore, the image pattern area can be readily removed from the surface of the support, when subjected to an external physical force. For such a reason, the fixation of the photoconductive powder entirely loses its bearing, where such a refixing process as fixes the electroconductive powder as well of the image pattern section is not properly applied hence far from being claimable to the effect that an image pattern is formed directly on the surface of the support having an insulating property.

However, in the method of the present invention, an image pattern formed of an electroconductive powder on the surface of the insulating support is formed of an electroconductive powder, a photoconductive powder, or a mixture thereof, and the image pattern does not have such an unnecessary intermediate layer as in the case of the method disclosed in German OLS No. 2,154,146 remaining after development. Therefore, the method of the present invention does not involve the problems as set forth above. In this sense, the method of the present invention is entirely different from the method of German OLS No. 2,154,146. Furthermore, in the method of German OLS No. 2,154,146, the scattering of an electroconductive powder after the scattering of a photoconductive powder, and the scattering of these two kinds of powders concurrently are impracticable. However, in the method of the present invention, both scattering methods are practical, as set forth in detail below. This is another point wherein the method of the present invention is different from the method of German OLS No. 2,154,146.

Some examples of employing combinations of the photoconductive powder are shown in Examples 1 through 8 given above. Some examples of employing combinations of the photoconductive powder with the electroconductive powder will be given below.

EXAMPLE 9

An electroconductive powder of the composition set forth below was specifically prepared. 100 parts of alumina sol (20% non-volatiles), 40 parts of 100% saponified polyvinyl alcohol, 200 parts of water, and 200 parts of ethanol were mixed, and then spray dried. An electroconductive powder of a mean particle diameter of 20$\mu$ was thus obtained.

Any type of electroconductive powder proves to be suitable for this purpose, so long as the surface resistivity thereof is $10^{10}\Omega$sq or less, including an electroconductive polymer, a resin having polar groups and hydroscopic properties, any other electroconductive powders comprising an appropriate core material whose surface is covered with any of those electroconductive materials given above, or the like, for example, conductive pigments such as carbon black, a metal powder, etc. suspended in a resin or others such as carboxymethyl cellulose, polyvinylpyrrolidone, potassium or sodium polyvinylbenzenesulfonate, maleic acid anyhydride-vinylmonomer (such as styrene, methyl vinyl ether or vinylacetate) copolymer, maleic acid-vinyl monomer copolymer, polyacrylic acid, polymethacrylic acid, polyvinylbenzyltrimethylammonium chloride, poly N,N-dimethyl-, N-benzyl-, N-$\beta$-acryloxyethyl ammonium chloride, etc., in addition to the powder disclosed in German OLS No. 2,154,146.

This electroconductive powder was subjected to positive charging, and subsequently the powder was scattered over a poly-ethylene terephthalate film of a thickness of 100$\mu$. The quantity of the electroconductive powder thus scattered was 40 g/m$^2$.

Then, a negatively charged EPM phototoner was scattered over the surface at the rate of 70 g/m$^2$. In this case, the degree of charging was appropriately controlled so that the degree of the electric charge for the layer of the electroconductive powder as a whole would be zero. After subjecting to image wise exposure to light, thus neutralizing the electric charge of the electroconductive powder of the non-image areas, development thereof was conducted using an air stream of simultaneously remove both the electroconductive and the photoconductive particles in the light exposed areas. The velocity of the air for the development was 16 m/sec. Furthermore, a bias voltage of 100 V/cm was applied at the time of development.

As a result whereof, a superb image formed of the electroconductive powder was obtained.

Also, a vinyl chloride plate (one mm in thickness) and a polystyrene film (60$\mu$in thickness) were employed, respectively, in lieu of the polyethylene terephthalate, and a desirable result likewise was obtained.

EXAMPLE 10

When the operations were conducted in a similar manner, but with the sequence of scattering the electroconductive powder and the photoconductive powder reversed to that employed in Example 9 given above, a desirable result was obtained in the same manner as in Example 9.

EXAMPLE 11

An electroconductive powdered matter as set forth below was prepared. 60 parts of MgO or $Al_2O_3$, 60 parts of 100% saponified polyvinyl alcohol, 200 parts of water, and 300 parts of methanol were mixed, and then spray dried. The mean particle diameter was 10$\mu$.

This electroconductive powder was positively charged, and was scattered over a polyethylene terephthalate film of a thickness of 100$\mu$ at the rate of 70 g/m$^2$, and in subsequently, a negatively charged EPM phototoner was scattered at the rate of 70 g/m$^2$.

In this case, the degree of charging was appropriately controlled so that the degree of the electric charge for the layer of the electroconductive powder as a whole was zero. After exposure to light, an image was developed by the application of an air stream of a velocity of 18 m/sec. A bias voltage was applied at the rate of 150 V/cm.

As a result whereof, a superb image formed of the electroconductive powder was obtained.

Furthermore, where the sequence of scattering the electroconductive powder and the EPM phototoner was reversed, and were scattered concurrently, as well, a desirable result was obtained.

EXAMPLE 12

80 parts of alumina sol (20% non-volatiles), 4 parts of colloidal silica, 40 parts of styrene/maleic acid anhydride copolymer, 0.5 part of benzyl trimethyl ammonium chloride, and 400 parts of methanol were dispersed, then subjected to spray drying. The product thus obtained was employed as an electroconductive powder. The mean particle diameter was approximately 10$\mu$. After positive charging, this electroconductive powder was scattered over a polyethylene terephthalate film of a thickness of 100$\mu$ at the rate of 50 g/m$^2$. When the same conditions as in the case of Example 9 given above were used, a desirable image formed of the electroconductive powder was obtained.

EXAMPLE 13

80 parts of alumina sol (20% non-volatiles), 4 parts of colloidal silica, 40 parts of styrene/maleic acid anhydride copolymer, 5 parts of polyvinyl pyrrolidone 350 parts of methanol, and 50 parts of toluene were kneaded, and then spray dried. The mean particle diameter produced was 13$\mu$.

When a series of evaluations were conducted in the same manner as in the case of Example 12 given above, employing the electroconductive powder produced in such a manner as set forth above, a desirable image formed of the electroconductive powder was obtained.

EXAMPLE 14

100 parts of calcium carbonate (or MgO, or $Al_2O_3$), 25 parts of the sodium salt of polyvinyl benzene sulfonate, 25 parts of 100% saponified polyvinyl alcohol, and 300 parts of water were mixed, and then subjected to spray drying. The mean particle diameter thus produced was 10$\mu$.

After positive charging, this electroconductive powder was scattered over a polyester terephthalate film of a thickness of 100$\mu$ at the rate of 60 g/m$^2$. When a series of evaluations were conducted using the EPM phototoner, under the same conditions as in the case of Example 4 given above, a desirable image formed of this electroconductive powder was obtained.

EXAMPLE 15

100 parts of toluene were added to 30 parts of a mixture prepared by thoroughly kneading 5 parts of carbon black, 10 parts of alkyd resin, and 100 parts of toluene for 10 hours in a ball mill, furthermore, 300 parts of styrene-methyl methacrylate copolymer (50$\mu$ in diameter) were added thereto as a core material and mixed, and then subjected to spray during, whereby an electroconductive powder a mean particle diameter of 52$\mu$ featuring a high level of phototransparency was obtained.

(Since this electroconductive powder has especially superb phototransparency, the powder proved to be suitable for employment for the layer B, and in the case of for employment as a mixture with a photoconductive powder.)

After being charged positively, this electroconductive powder was scattered at a rate of 70 g/m$^2$.

The EPM phototoner was employed as the photoconductive powder, and after being charged negatively, the photoconductive powder was scattered at a rate of 70 g/m$^2$.

A series of evaluations were conducted, with regard to scattering the electroconductive powder first, scattering the photoconductive powder first, and scattering both the powders concurrently, respectively. A polyethylene terephthalate film of a thickness of 100$\mu$ was used as the insulating support.

When development (using an air stream at a velocity of 18 m/sec) was conducted under a bias voltage of 150 V/cm, after appropriate image wise exposure, a desirable image formed of the powders was obtained.

EXAMPLE 16

| | |
|---|---|
| Photoconductive Powder : Zinc Oxide (Sazex 2000, Manufactured by Sakai Chemistry Co.) | 1200 parts |
| Binder : Silicone Resin (KR-255, manufactured by Shinetsu Silicone Co.) | 150 parts |
| Hardening Agent : Zinc and Tin Salts of Organic Acids (DX-255, Manufactured by Shinetsu Chemistry) | 1 part |
| Sensitizer : Eosin Y (used as an ethanol solution) | 0.6 part |
| Fatigue preventing Agent : Copper Stearate | 0.8 part |

The composition shown above was coated on particles of polystyrene (average particle diameter: 150 microns) by spray drying. The thickness of the coating was 4 microns. The coating was hardened at 80° C for 15 hours. The particles satisfying $\sigma = \mu/2$ ($\mu$ = 158) were obtained by classification.

A copper plate having a coating of paint in a thickness of 20$\mu$ on one side of surfaces thereof was used as a support. The surface resistivity of paint coated surface was more than $10^{14}\Omega/cm^2$.

The powder was charged negatively and scattered over the painted surface at a rate of 120 g/m$^2$. The surface voltage of the layer of the scattered powder was −500 volts. The powder produced above a charged positively and scattered over the layer of the negatively charged powder at a rate of 120 g/m$^2$. The amounts of positive and negative charges were controlled so as to make them equal.

Thus obtained photographic material was exposed imagewise in a quantity of light of about 600 lux. sec.

An air-blow development was carried out applying a bias voltage of 200 volt/cm. The air pressure was 120 mm ag. and the air velocity was 20 m/sec. A clear photoconductive powder image was obtained.

EXAMPLE 17

Instead of zinc oxide, a powder of cadmium sulfide type ($CdS \cdot nCdCO_3 \cdot n$:1–4 Cadmium Yellow Orange, manufactured by Mitsui Metal Mining Co.) and polystryrene powder having an average diameter of 100 microns was used in Example 16. A photoconductive powder having a coating thickness of 3 microns was obtained. The particles which satisfies $2\sigma \leqq 0.9\mu(\mu = 106)$ were obtained by classification.

The positively and negatively charged powder were scattered at rate of 100 g/m$^2$ respectively in the same manner as described in Example 16. The thus obtained photographic material was exposed imagewise in a light amount of 10 lux. sec. The surface resistance was the same as that in Example 16. The air-blow development was carried out as disclosed in Example 16. A clear photoconductive powder image was obtained.

EXAMPLE 18

Polystyrene powder having an average particle diameter of 70 microns was used in Example 16. The thickness of the coating of the photoconductive composition was 3 microns. The particles which satisfies $\sigma \leqq \mu/2$ ($\mu$=76 microns) were obtained by classification.

A polyethylene film having a thickness of 100 microns was discharged by an alternating current corona charging to +10 volts of a surface voltage.

The powder obtained above was charged negatively and scattered over the polyethylene film at a rate of 60 g/cm$^2$. The surface voltage was −350 volts. The powder charged positively was scattered over the layer of the negatively charged powder. The surface voltage was +20 volts.

The thus obtained photographic material was exposed imagewise in a quantity of light of 450 lux. sec. An air-blow development was carried out with applying a bias voltage of 300 volts/cm, 120 mm eq. of air pressure and 20 m/sec of air velocity. An excellent image without a fog was obtained.

EXAMPLE 19

The electroconductive powder used in Example 15, the photoconductive powder used in Example 18, and as a support an iron plate were used in this example.

The electroconductive powder was charged while scattered over the iron plate at a rate of 60 g/m$^2$. The particles reached to the support discharged immediately. Therefore, the electroconductive powder need not be charged, however, it is preferable to charge the powder to scatter it uniformly.

The photoconductive powder was charged and scattered over the electroconductive powder on the iron plate at a rate of 60 g/cm$^2$. the surface voltage was −400 volts.

Thus obtained photographic material was exposed imagewise in a quantity of light 350 lux. sec.

Then an air-blow development was carried out at 100 mm eq. of air-pressure and 16 m/sec of air-velocity. An excellent image was obtained.

A voltage of −200 volts was applied to the support, and the photoconductive powder at the image portion was removed by using the static repulsion force. The remaining electroconductor powder image was fixed by applying a spray of methylenechloride.

EXAMPLE 20

Polystyrene spheres having a mean particular size of 190$\mu$ were used as core material and these spheres treated with palladium by electroless plating to obtain electroconductive powders having high phototransparency.

Using the thus obtained electroconductive powder and the photoconductive powder as described in Example 16, a powder image was obtained in the following manner.

A coated steel plate was used as a substrate. On this substrate a negatively charged photoconductive powder was uniformly sprayed at a rate of 100 g/m$^2$ to obtain a surface potential of −350 volts. A positively charged electroconductive powder was then uniformly spread on the photoconductive powder layer at a rate of 90 g/m$^2$ to obtain a surface potential of +20 volts. The powder layer was then exposed imagewisely at an amount of 400 Lux. sec. The powder at the non-exposed area was removed by developing to obtain a powder image in the exposed area in the following manner.

As a developing electrode, a metal roller having a diameter of 100 mm coated with a resin to insulate the surface was used. The developing electrode was placed over the steel plate at a distance of 5 – 10 mm. A bias voltage of −1000 volts was applied thereto with respect to the steel plate and the electrode was scanned with respect to the plate at a speed of 10 cm/sec.

The electroconductive powder having electrostatic charges was attracted electrostatically and transferred to the developing electrode roller. The metal roller was rotated on its axis at a rate of 30 rpm, and the electroconductive powder transferred to the roller was suctioned and recovered through a suction nozzle placed over the roller.

A bias voltage of +1000 volts was then applied to the roller and the metal roller was scanned with the respect to the plate in the same manner as described above to recover the photoconductive powder having electrostatic charges, and a good powder image was obtained. The thus obtained powder image was fixed by spraying ethylenechloride.

As described above, it is possible to electrostatically recover and develop the electroconductive layer and the photoconductive layer separately.

Further, it is, of course, possible to spray the electroconductive powder first. However, when the surface of a substrate is electroconductive and the electroconductive powder is sprayed first, this developing method can not be used, since injection of electric charges from the substrate to the electroconductive powder occurs.

While the invention has been described in detail and with reference to specific embodiments thereof, it will be apparent to one skilled in the art that various changes and modifications can be made therein without departing from the spirit and scope thereof.

What is claimed is:

1. An electrophotographic method comprising image-wise exposing the surface of a support having thereon at least one layer of (a) first photoconductive powders either positively or negatively electrically charged and (b) further powders selected from the group consisting of electroconductive powders having a surface resistivity of $10^{10}\Omega$sq. or less and second photoconductive powders, said further powders being applied to said surface of said support no earlier than the application of said first photoconductive powders to the support and said further powders being charged in a reverse polarity to that of the first photoconductive powders where the total amount of the positive and negative charges on said first and further powders is approximately zero to thereby form an electrostatic latent image as a result of said image-wise exposing the photoconductive powders where any of said further powders in the upper portion of said layer are phototransparent in at least a portion of the wavelength range to which said first photoconductive powders not in said upper portion are sensitive, said photoconductive and electroconductive powders being 1 – 200 microns in size, and then removing either the image-wise exposed or unexposed portion of the powders to form an image.

2. The method of claim 1 where said first and second photoconductive powders are the same kind of powder.

3. The method of claim 1 wherein said first and second photoconductive powders have different spectral sensitivies.

4. The method of claim 1 wherein said first and second photoconductive powders have different visible appearances.

5. The method of claim 1 wherein said removing of the exposed portion of the powders is effected by using an air stream, said method including applying a bias voltage during said removing.

6. The method of claim 1 wherein said the oppositely charged powders are separately scattered in two layers whereby electric double layers are formed, said further powders being in the top layer and phototransparent in at least a portion of the wavelength range to which said first photoconductive powders are sensitive.

7. The method of claim 1 wherein said oppositely charged powders are scattered simultaneously on said support as a single layer where said first photoconductive powders are phototransparent in at least a portion of the wavelength range to which said second photoconductive powders are sensitive and said further powders are phototransparent in at least a portion of the wavelength range to which said first photoconductive powders are sensitive.

8. The method of claim 1 wherein said support is electrically insulating.

9. The method of claim 8 where said support is charged in an amount less than about one-fifth of the charge of the positive or negative powder.

10. The method of claim 1 wherein said support is a metallic support.

11. The method of claim 1 where said average particle diameter is 1 – 150 microns.

12. An electrophotographic method comprising image-wise exposing the surface of a support having thereon at least one layer of first photoconductive powders either positively or negatively electrically charged and further photoconductive powders charged in a reverse polarity to that of the first photoconductive powders where the total amount of the positive and negative charges on said photoconductive powders is approximately zero to thereby form an electrostatic latent image where any of said further photoconductive powders in the upper portion of said layer are phototransparent in at least a portion of the wavelength range to which said first photoconductive powders not in said upper portion are sensitive, said photoconductive powders being 1 – 200 microns in size, and then removing either the image-wise exposed or unexposed portion of the powders to form an image.

13. An electrophotographic method comprising forming on a support a layer of photoconductive powders, forming on said layer of photoconductive powders a layer of electroconductive powders having a surface resistivity of $10^{10}\Omega$sq. or less and a phototransparency in at least a portion of the wavelength range to which said photoconductive powders are sensitive, image-wise exposing the surface of said support having thereon said photoconductive powders either positively or negatively electrically charged and said electroconductive powders charged in a reverse polarity to that of the photoconductive powders where the total amount of the positive and negative charges on said photoconductive and electroconductive powders is approximately zero to thereby form an electrostatic latent image, said photoconductive and electroconductive powders being 1 – 200 microns in size, and then removing the image-wise exposed or unexposed portion of the powders to form an image.

14. An electrophotographic method comprising forming on an electroconductive support a layer of electroconductive powders having a surface resistivity of $10^{10}\Omega$sq. or less, forming on said layer of electroconductive powders a layer of photoconductive powders, image-wise exposing the surface of said support having thereon said photoconductive powders either positively or negatively electrically charged and said electroconductive powders charged in a reverse polarity to that of the photoconductive powders where the total amount of the positive and negative charges on said photoconductive and electroconductive powders is approximately zero to thereby form an electrostatic latent image, said photoconductive powders being 1 – 200 microns in size, and then removing the image-wise exposed or unexposed portion of the powders to form an image.

15. An electrophotographic method comprising image-wise exposing the surface of an electroconductive support having thereon at least one layer of (a) first photoconductive powders either positively or negatively electrically charged and (b) further powders selected from the group consisting of electroconductive powders having a surface resistivity of $10^{10}\Omega$sq. or less and second photoconductive powders, said further powders being charged in a reverse polarity to that of the first photoconductive powders where the total amount of the positive and negative charges on said photoconductive and further powders is approximately zero to thereby form an electrostatic latent image as a result of said image-wise exposing the photoconductive powders where any of said further powders in the upper portion of said layer are phototransparent in at least a portion of the wavelength range to which said first photoconductive powders not in said upper portion are sensitive, said photoconductive and electroconductive powders being 1 – 200 microns in size, and then removing either the image-wise exposed or unexposed portion of the powders to form an image.

16. The method of claim 1 where said removing of the exposed portion of the powders is effected by using an air stream and the amounts of said positive and negative charges may be different from each other within 15% based on the amount of the charge.

17. The method of claim 12 where said removing of the exposed portion of the powders is effected by using an air stream and the amounts of said positive and negative charges may be different from each other within 15% based on the amount of the charge.

18. The method of claim 13 where said removing of the exposed portion of the powders is effected by using an air stream and the amounts of said positive and negative charges may be different from each other within 15% based on the amount of the charge.

19. The method of claim 14 where said removing of the exposed portion of the powders is effected by using an air stream and the amounts of said positive and negative charges may be different from each other within 15% based on the amount of the charge.

20. The method of claim 15 where said removing of the exposed portion of the powders is effected by using an air stream and the amounts of said positive and negative charges may be different from each other within 15% based on the amount of the charge.

* * * * *